US009523540B2

(12) United States Patent
Hirayama et al.

(10) Patent No.: US 9,523,540 B2
(45) Date of Patent: Dec. 20, 2016

(54) HEAT EXCHANGER WITH HEADER TANK INCLUDING TANK CONSTITUTING MEMBERS

(71) Applicant: KEIHIN THERMAL TECHNOLOGY CORPORATION, Oyama-shi (JP)

(72) Inventors: Takashi Hirayama, Oyama (JP); Motoyuki Takagi, Oyama (JP); Atsuo Ohashi, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 341 days.

(21) Appl. No.: 13/851,966

(22) Filed: Mar. 28, 2013

(65) Prior Publication Data

US 2013/0255926 A1 Oct. 3, 2013

(30) Foreign Application Priority Data

Apr. 3, 2012 (JP) ..... 2012-084815

(51) Int. Cl.
*F28F 9/02* (2006.01)
*F28F 1/00* (2006.01)
(Continued)

(52) U.S. Cl.
CPC ..... *F28F 1/00* (2013.01); *F28D 1/05391* (2013.01); *F28F 9/026* (2013.01); *F28F 9/0214* (2013.01);
(Continued)

(58) Field of Classification Search
CPC ..... F28F 9/02; F28F 9/0243; F28F 9/0224; F28F 9/0226; F28F 1/00; F28F 9/026; F28F 9/0214; F28D 2021/0085; F28D 1/05391; Y10T 29/4935
(Continued)

(56) References Cited

U.S. PATENT DOCUMENTS 4,738,308 A * 4/1988 Moranne ..... F28D 1/05333 165/149
5,355,944 A * 10/1994 Potier ..... F28D 1/053 165/149
(Continued)

FOREIGN PATENT DOCUMENTS

JP 60-066987 U 5/1985
JP 2009097776 A * 5/2009
(Continued)

OTHER PUBLICATIONS

JP 2009097776 A machine translation.*
Japanese Office Action for corresponding JP Application No. 2012-084815, Feb. 9, 2016.

*Primary Examiner* — Len Tran
*Assistant Examiner* — Gordon Jones
(74) *Attorney, Agent, or Firm* — Mori & Ward, LLP

(57) ABSTRACT

A heat exchanger includes a pair of header tanks and a plurality of heat exchange tubes. The header tank includes the three tank constituting members having laminated portions. Each of the laminated portions is composed of an outer vertical wall portion, an inner vertical wall portion, and an intermediate vertical wall portion. A fillet is formed between an outer surface of the intermediate vertical wall portion with respect to an air-passing direction and an inner surface of the outer vertical wall portion with respect to the air-passing direction. Another fillet is formed between an inner surface of the intermediate vertical wall portion with
(Continued)

respect to the air-passing direction and an outer surface of the inner vertical wall portion with respect to the air-passing direction.

5 Claims, 5 Drawing Sheets

(51) Int. Cl.
*F28D 1/053* (2006.01)
*F28D 21/00* (2006.01)

(52) U.S. Cl.
CPC ..... *F28F 9/0224* (2013.01); *F28D 2021/0085* (2013.01); *Y10T 29/4935* (2015.01)

(58) Field of Classification Search
USPC ..... 165/175, 173
See application file for complete search history.

(56) References Cited

U.S. PATENT DOCUMENTS

| | | | | |
|---|---|---|---|---|
| RE35,098 | E * | 11/1995 | Saperstein | 29/890.043 |
| 5,934,365 | A * | 8/1999 | Rhodes et al. | 165/173 |
| 7,343,966 | B2 * | 3/2008 | Nitta | F28D 1/0475 165/174 |
| 7,726,387 | B2 * | 6/2010 | Higashiyama | 165/144 |
| 2003/0145465 | A1 * | 8/2003 | Anders | B21C 37/0803 29/890.053 |
| 2006/0118285 | A1 * | 6/2006 | Emrich et al. | 165/173 |
| 2009/0056927 | A1 * | 3/2009 | Zobel | B21C 37/151 165/180 |
| 2010/0051247 | A1 * | 3/2010 | Sogabe et al. | 165/151 |
| 2010/0083694 | A1 | 4/2010 | Takagi et al. | |

FOREIGN PATENT DOCUMENTS

| | | |
|---|---|---|
| JP | 2010-112695 | 5/2010 |
| JP | 2011-064379 | 3/2011 |

* cited by examiner

HEAT EXCHANGER WITH HEADER TANK INCLUDING TANK CONSTITUTING MEMBERS

CROSS-REFERENCE TO RELATED APPLICATIONS

The present application claims priority under 35 U.S.C. §119 to Japanese Patent Application No. 2012-084815, filed Apr. 3, 2012. The contents of this application are incorporated herein by reference in their entirety.

BACKGROUND OF THE INVENTION

Field of the Invention

The present invention relates to a heat exchanger and to a method of manufacturing the heat exchanger.

Discussion of the Background

A heat exchanger which is used for, for example, an evaporator of a car air conditioner has been known (see Japanese Patent Application Laid-Open (kokai) No. 2010-112695). The known heat exchanger includes a pair of header tanks disposed apart from each other and each having windward and leeward header sections, and a plurality of heat exchange tubes which are disposed between the two header tanks and whose opposite end portions are connected to the corresponding header tanks. Each of the header tanks includes a first tank constituting member to which the heat exchange tubes are connected, a second tank constituting member which is joined to the first tank constituting member and which covers one side of the first tank constituting member opposite the heat exchange tubes, and a third tank constituting member which is disposed between the first and second tank constituting members. The first tank constituting member has two header forming portions for forming heat-exchange-tube-side portions of the header section main bodies of the windward and leeward header sections, and a connection portion for connecting the two header forming portions. The second tank constituting member has two header forming portions for forming outer portions of the header section main bodies of the windward and leeward header sections, and a connection portion for connecting the two header forming portions. The third tank constituting member has partition portions for dividing the interiors of the header section main bodies of the windward and leeward header sections into upper and lower spaces, and a connection portion for connecting the two partition portions. Each of the header tanks has laminated portions which are formed at opposite edges thereof with respect to an air-passing direction as a result of overlapping of vertical wall portions of the tank constituting members formed at opposite edges thereof with respect to the air-passing direction. Each of the laminated portions is composed of a perpendicularly extending outer vertical wall portion which is provided on the first tank constituting member and is located at the outermost position, a perpendicularly extending inner vertical wall which is provided on the second tank constituting member and is located at the innermost position, and a perpendicularly extending intermediate vertical wall portion which is provided on the third tank constituting member and is located between the outer and inner vertical wall portions.

The heat exchanger disclosed in the publication is manufactured by a method in which the first through third tank constituting members are assembled together such that the perpendicularly extending outer vertical wall portion, the perpendicularly extending inner vertical wall portion, and the perpendicularly extending intermediate vertical wall portion are laminated, and the three tank constituting members are provisionally fixed together by means of crimping at the connection portions.

SUMMARY OF THE INVENTION

According to one aspect of the present invention, a heat exchanger includes a pair of header tanks and a plurality of heat exchange tubes. The pair of header tanks is disposed apart from each other such that their width direction coincides with an air-passing direction. The plurality of heat exchange tubes are disposed between the two header tanks and whose opposite end portions are connected to the corresponding header tanks. At least one of the header tanks includes a first tank constituting member to which the heat exchange tubes are connected, a second tank constituting member which is joined to the first tank constituting member and which covers one side of the first tank constituting member opposite the heat exchange tubes, and a third tank constituting member which is disposed between the first and second tank constituting members. The header tank includes the three tank constituting members having laminated portions which are formed at opposite edges of the header tank with respect to the air-passing direction as a result of overlapping of vertical wall portions of the tank constituting members formed at opposite edges thereof with respect to the air-passing direction. Each of the laminated portions is composed of an outer vertical wall portion located at the outermost position, an inner vertical wall located at the innermost position, and an intermediate vertical wall portion located between the outer and inner vertical wall portions. The outer vertical wall portion is provided on one of the first and second tank constituting members. The inner vertical wall portion is provided on the other of the first and second tank constituting members. The intermediate vertical wall portion is provided on the third tank constituting member. The intermediate vertical wall portion of the third tank constituting member is inclined outward in the air-passing direction toward a distal end thereof such that as viewed on a transverse cross section. An outer surface of the intermediate vertical wall portion with respect to the air-passing direction and an inner surface of the outer vertical wall portion with respect to the air-passing direction meet and form an acute angle therebetween and an inner surface of the intermediate vertical wall portion with respect to the air-passing direction and an outer surface of the inner vertical wall portion with respect to the air-passing direction meet and form an acute angle therebetween. A fillet is formed between the outer surface of the intermediate vertical wall portion with respect to the air-passing direction and the inner surface of the outer vertical wall portion with respect to the air-passing direction, and another fillet is formed between the inner surface of the intermediate vertical wall portion with respect to the air-passing direction and the outer surface of the inner vertical wall portion with respect to the air-passing direction.

According to another aspect of the present invention, in a method of manufacturing the heat exchanger, the first through third tank constituting members are formed such that the two intermediate vertical wall portions of the third tank constituting member are inclined outward with respect to the air-passing direction toward the distal ends thereof, a distance between the inner surfaces of the two outer vertical wall portions measured at the distal ends thereof is smaller than a distance between the outer surfaces of the two intermediate vertical wall portions measured at the distal ends thereof, and a distance between the outer surfaces of the two inner vertical wall portions measured at the distal ends thereof is larger than a distance between the inner surfaces of the two intermediate vertical wall portions measured at the base ends thereof. The first through third tank constituting members are assembled together such that the outer vertical wall portions, the inner vertical wall portions, and the intermediate vertical wall portions are laminated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
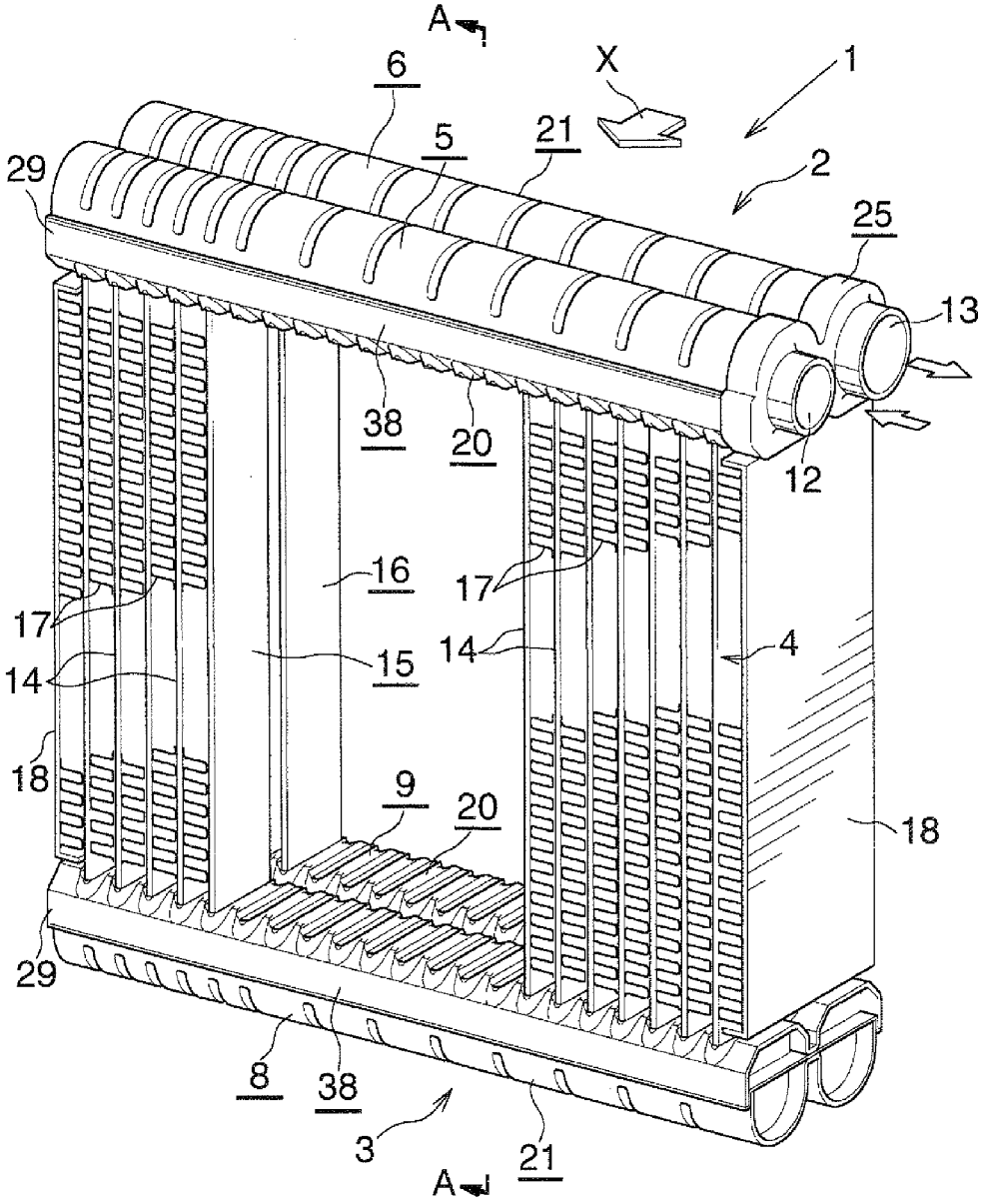
FIG. 1 is a partially cut-away perspective view showing the overall structure of an evaporator to which a heat exchanger according to an embodiment is applied.

The embodiments will now be described with reference to the accompanying drawings, wherein like reference numerals designate corresponding or identical elements throughout the various drawings.

In the embodiment to be described later, the heat exchanger according to the embodiment is applied to an evaporator of a refrigeration cycle which constitutes a car air conditioner.

The term "aluminum" as used in the following description encompasses aluminum alloys in addition to pure aluminum.

In the following description, the downstream side with respect to an air-passing direction (a direction represented by arrow X in FIGS. 1 and 2), which is the direction of air passing through air-passing clearances between adjacent heat exchange tubes, will be referred to as the "front," and the opposite side as the "rear." Also, the upper, lower, left-hand, and right-hand sides as viewed rearward from the front side; i.e., the upper, lower, left-hand, and right-hand sides of FIG. 1 will be referred to as "upper," lower," "left," and "right," respectively.

Figure 2:
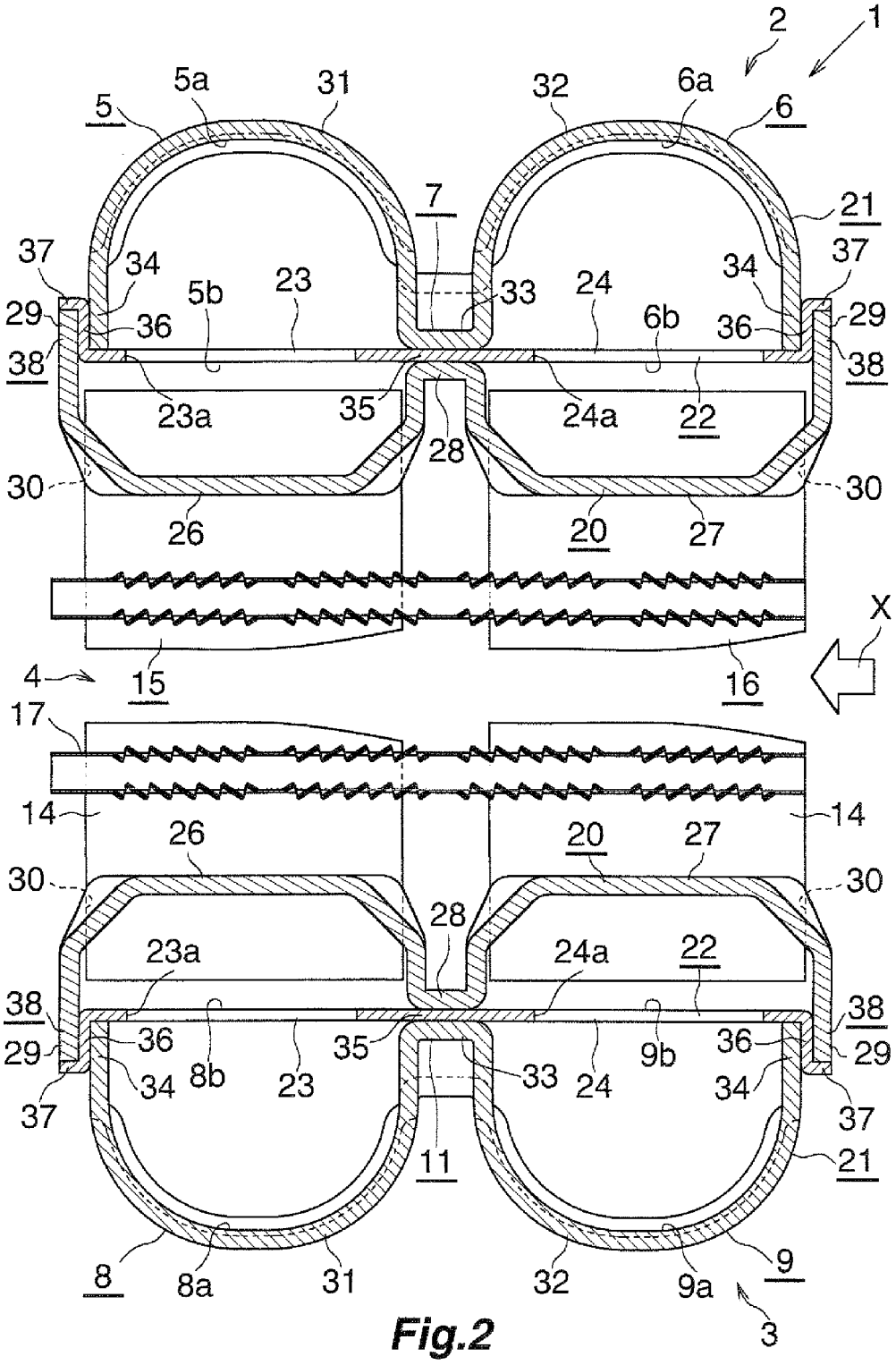
FIG. 2 is a partially omitted enlarged sectional view taken along line A-A of FIG. 1.
Figure 3:
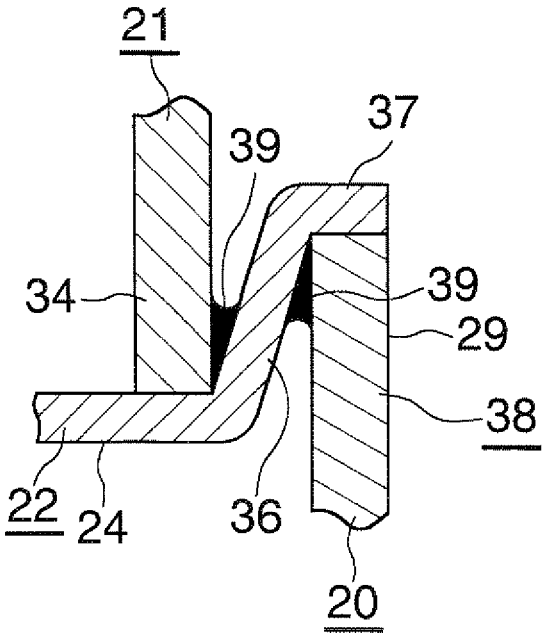
FIG. 3 is an enlarged view of a main portion of FIG. 2.

FIG. 1 shows the overall structure of an evaporator to which the heat exchanger according to the embodiment is applied, and FIGS. 2 and 3 show the structure of a main or essential portion of the evaporator.

As shown in FIGS. 1 and 2, an evaporator 1 includes an upper header tank 2 and a lower header tank 3 formed of aluminum and disposed apart from each other in the vertical direction such that their width direction coincides with the air-passing direction and their longitudinal direction coincides with the left-right direction; and a heat exchange core section 4 provided between the two header tanks 2 and 3.

The upper header tank 2 includes a leeward header section 5 disposed on the leeward side (front side) such that their longitudinal direction coincides with the left-right direction; a windward header section 6 disposed on the windward side (rear side) such that their longitudinal direction coincides with the left-right direction; and a connection portion 7 which connects and unites the two header sections 5 and 6 together. The lower header tank 3 includes a leeward header section 8 disposed on the leeward side (front side) such that their longitudinal direction coincides with the left-right direction; a windward header section 9 disposed on the windward side (rear side) such that their longitudinal direction coincides with the left-right direction; and a connection portion 11 which connects and unites the two header sections 8 and 9 together. In the following description, the leeward header section 5 of the upper header tank 2 will be referred as a leeward upper header section; the leeward header section 8 of the lower header tank 3 will be referred to as a leeward lower header section; the windward header section 6 of the upper header tank 2 will be referred to as a windward upper header section; and the windward header section 9 of the lower header tank 3 will be referred to as a windward lower header section. A refrigerant inlet 12 is provided at the right end of the leeward upper header section 5, and a refrigerant outlet 13 is provided at the right end of the windward upper header section 6.

In the heat exchange core section 4, two tube rows 15 and 16 are juxtaposed in the front-rear direction. Each of the tube rows 15 and 16 is composed of a plurality of flat heat exchange tubes 14 which are formed of aluminum extrudate and which are disposed such that they are spaced apart from one another in the left-right direction and such that their longitudinal direction coincides with the vertical direction and their width direction coincides with the air-passing direction. Corrugate fins 17 formed of aluminum are disposed in air-passing clearances between adjacent heat exchange tubes 14 of each of the tube rows 15 and 16 and on the outer sides of the heat exchange tubes 14 at the left and right ends such that the corrugate fins 17 extend across the heat exchange tubes 14 of the front and rear tube rows 15 and 16. The corrugate fins 17 are brazed to the corresponding heat exchange tubes 14. Side plates 18 formed of aluminum are disposed on the outer sides of the corrugate fins 17 at the left and right ends and are brazed to the corresponding corrugate fins 17. Upper and lower end portions of the heat exchange tubes 14 of the leeward tube row 15 are communicatably connected to the leeward upper and lower header sections 5 and 8 in a state in which the upper and lower end portions project into the interiors of the leeward upper and lower header sections 5 and 8. Upper and lower end portions of the heat exchange tubes 14 of the windward tube row 16 are communicatably connected to the windward upper and lower header sections 6 and 9 in a state in which the upper and lower end portions project into the interiors of the windward upper and lower header sections 6 and 9. The number of the heat exchange tubes 14 of the leeward tube row 15 is equal to the number of the heat exchange tubes 14 of the windward tube row 16. The corrugate fins 17 are shared by the front and rear heat exchange tubes 14, which constitute the leeward tube row 15 and the windward tube row 16, respectively.

The upper header tank 2 includes a first tank constituting member 20, a second tank constituting member 21, a third tank constituting member 22, and an end member 25, which are formed of aluminum. The first tank constituting member 20 forms lower portions of the leeward upper header section 5 and the windward upper header section 6, and the heat exchange tubes 14 of the two tube rows 15 and 16 are connected to the first tank constituting member 20. The second tank constituting member 21 is brazed to the first tank constituting member 20, covers the side (upper side) of the first tank constituting member 20 opposite the heat exchange tubes 14, and forms upper portions of the leeward upper header section 5 and the windward upper header section 6. The third tank constituting member 22 is disposed between the first tank constituting member 20 and the second tank constituting member 21 and has front and rear partition portions 23 and 24 for dividing the interiors of the leeward upper header section 5 and the windward upper header section 6 into upper spaces 5*a* and 6*a* and lower spaces 5*b* and 6*b*. The end member 25 has the refrigerant inlet 12 and the refrigerant outlet 13, and is brazed to the right ends of the first through third tank constituting members 20, 21, and 22. A through hole 23*a* formed in the front partition portion 23 establishes communication between the upper and lower spaces 5*a* and 5*b* of the leeward upper header section 5, and a through hole 24*a* formed in the rear partition portion 24 establishes communication between the upper and lower spaces 6*a* and 6*b* of the windward upper header section 6.

The first tank constituting member 20 is formed by performing press work on an aluminum brazing sheet having a brazing material layer on each of opposite sides thereof. The first tank constituting member 20 includes a first header forming portion 26 which has a generally U-like shape as viewed on a transverse cross section thereof and which forms a lower portion (a portion on the side toward the heat exchange tubes 14) of the leeward upper header section 5; a second header forming portion 27 which has a generally U-like shape as viewed on a transverse cross section thereof and which forms a lower portion (a portion on the side toward the heat exchange tubes 14) of the windward upper header section 6; and a connection wall 28 which connects the two header forming portions 26 and 27 together and which forms a lower portion of the connection portion 7. Perpendicularly extending vertical wall portions 29 which project upward (outward with respect to the vertical direction) from the two partition portions 23 and 24 of the third tank constituting member 22 are integrally formed along the front edge (edge on the downstream side with respect to the air-passing direction) of the first header forming portion 26 of the first tank constituting member 20 and along the rear edge (edge on the upstream side with respect to the air-passing direction) of the second header forming portion 27 of the first tank constituting member 20. Tube insertion holes 30 elongated in the front-rear direction are formed in the header forming portions 26 and 27 of the first tank constituting member 20 such that they are spaced from one another in the left-right direction and the tube insertion holes 30 of the header forming portion 26 are located at the same positions (in the left-right direction) as those of the corresponding tube insertion holes 30 of the header forming portion 27. Upper end portions of the heat exchange tubes 14 are inserted into the tube insertion holes 30 and are brazed to the first tank constituting member 20 by making use of the brazing material layer of the first tank constituting member 20.

The second tank constituting member 21 is formed by performing press work on an aluminum brazing sheet having a brazing material layer on each of opposite sides thereof. The second tank constituting member 21 includes a first header forming portion 31 which has a generally inverted U-like shape as viewed on a transverse cross section thereof and which forms an upper portion (a portion on the side opposite the heat exchange tubes 14) of the leeward upper header section 5; a second header forming portion 32 which has a generally inverted U-like shape as viewed on a transverse cross section thereof and which forms an upper portion (a portion on the side opposite the heat exchange tubes 14) of the windward upper header section 6; and a connection wall 33 which connects the two header forming portions 31 and 32 together and which forms an upper portion of the connection portion 7. Perpendicularly extending vertical wall portions 34 the lower end surfaces of which butt against the two partition portions 23 and 24 of the third tank constituting member 22 are integrally formed along the front edge (edge on the downstream side with respect to the air-passing direction) of the first header forming portion 31 of the second tank constituting member 21 and along the rear edge (edge on the upstream side with respect to the air-passing direction) of the second header forming portion 32 of the second tank constituting member 21 such that the vertical wall portions 34 are located inward of and away from the vertical wall portions 29 of the first tank constituting member 20 with respect to the air-passing direction.

The third tank constituting member 22 is formed by performing press work on an aluminum brazing sheet having a brazing material layer on each of opposite sides thereof. The front and rear partition portions 23 and 24 of the third tank constituting member 22 are connected and united together by a connection wall 35 which is disposed between the connection wall 28 of the first tank constituting member 20 and the connection wall 33 of the second tank constituting member 21 and is brazed to the two connection walls 28 and 33. The connection wall 35 forms an intermediate portion (with respect to the vertical direction) of the connection portion 7. The two partition portions 23 and 24 and the connection wall 35 are located on the same plane. Vertical wall portions 36 which extend vertically into the spaces between the vertical wall portions 29 of the first tank constituting member 20 and the vertical wall portions 34 of the second tank constituting member 21 are integrally formed along the front edge (edge on the downstream side with respect to the air-passing direction) of the front partition portion 23 of the third tank constituting member 22 and along the rear edge (edge on the upstream side with respect to the air-passing direction) of the rear partition portion 24 of the third tank constituting member 22. Outward projecting portions 37 which project outward with respect to the air-passing direction are integrally formed on the upper ends (outer ends with respect to the vertical direction) of the vertical wall portions 36.

Accordingly, laminated portions 38 formed as a result of overlapping of the vertical wall portions 29, 34, and 36 formed along the front and rear edges of the first through third tank constituting members 20, 21, and 22 are provided along the front and rear edges (opposite edges in the air-passing direction) of the upper header tank 2. In each of the laminated portions 38, the vertical wall portion 29 of the first tank constituting member 20 serves as an outer vertical wall portion located at the outermost position, the vertical wall portion 34 of the second tank constituting member 21 serves as an inner vertical wall portion located at the innermost position, and the vertical wall portion 36 of the third tank constituting member 22 serves as an intermediate vertical wall portion located between the outer and inner vertical wall portions.

As specifically shown in FIG. 3, each of the intermediate vertical wall portions 36 of the third tank constituting member 22 inclines outward in the air-passing direction toward the distal end thereof. As viewed on a transverse cross section, the outer surface (with respect to the air-passing direction) of the intermediate vertical wall portion 36 and the inner surface (with respect to the air-passing direction) of the outer vertical wall portion 29 of the first tank constituting member 20 meet and form an acute angle therebetween, and the inner surface (with respect to the air-passing direction) of the intermediate vertical wall portion 36 and the outer surface (with respect to the air-passing direction) of the inner vertical wall portion 34 of the second tank constituting member 21 meet and form an acute angle therebetween. A fillet 39 is formed between the outer surface (with respect to the air-passing direction) of the intermediate vertical wall portion 36 and the inner surface (with respect to the air-passing direction) of the outer vertical wall portion 29, and another fillet 39 is formed between the inner surface (with respect to the air-passing direction) of the intermediate vertical wall portion 36 and the outer surface (with respect to the air-passing direction) of the inner vertical wall portion 34. The distal end surface of each inner vertical wall portion 34 butts against and is brazed to a portion of the third tank constituting member 22 adjacent to the base end of the intermediate vertical wall portion 36; i.e., an outer edge portion of the partition portion 23 or 24 with respect to the air-passing direction. The distal end surface of each outer vertical wall portion 29 butts against and is brazed to the outward projecting portion 37 provided at the distal end of the intermediate vertical wall portion 36.

The lower header tank 3 and the upper header tank 2 are substantially identical in structure and are disposed in a mirror-image relation. Therefore, portions of the lower header tank 3 identical with those of the upper header tank 2 are denoted by the same reference numerals. Notably, the refrigerant inlet 12 and the refrigerant outlet 13 are not provided on the lower header tank 3, and therefore, the end portion 25 is also not provided on the lower header tank 3. The first tank constituting member 20 forms the upper portions of the leeward lower header section 8 and the windward lower header section 9. The second tank constituting member 21 covers the side (lower side) of the first tank constituting member 20 opposite the heat exchange tubes 14, and forms the lower portions of the leeward lower header section 8 and the windward lower header section 9. The front partition portion 23 of the third tank constituting member 22 divides the interior of the leeward lower header section 8 into upper and lower spaces 8*b* and 8*a*, and the rear partition portion 24 of the third tank constituting member 22 divides the interior of the windward lower header section 9 into upper and lower spaces 9*b* and 9*a*. A through hole 23*a* formed in the front partition wall 23 establishes communication between the upper and lower spaces 8*b* and 8*a* of the leeward lower header section 8, and a through hole 24*a* formed in the rear partition wall 24 establishes communication between the upper and lower spaces 9*b* and 9*a* of the windward lower header section 9.

In the above-described evaporator 1, a low-pressure two-phase refrigerant of vapor-liquid phase having been compressed by a compressor and having passed through a condenser and an expansion valve enters the leeward upper header section 5 of the evaporator 1 through the refrigerant inlet 12, and flows out of the refrigerant outlet 13 of the windward upper header section 6 after passing through all the heat exchange tubes 14. While flowing through the heat exchange tubes 14, the refrigerant is subjected to heat exchange with air flowing through the air-passing clearances each formed between the heat exchange tubes 14 located adjacent to each other in the left-right direction. The refrigerant then flows out in vapor phase.

Figure 4:
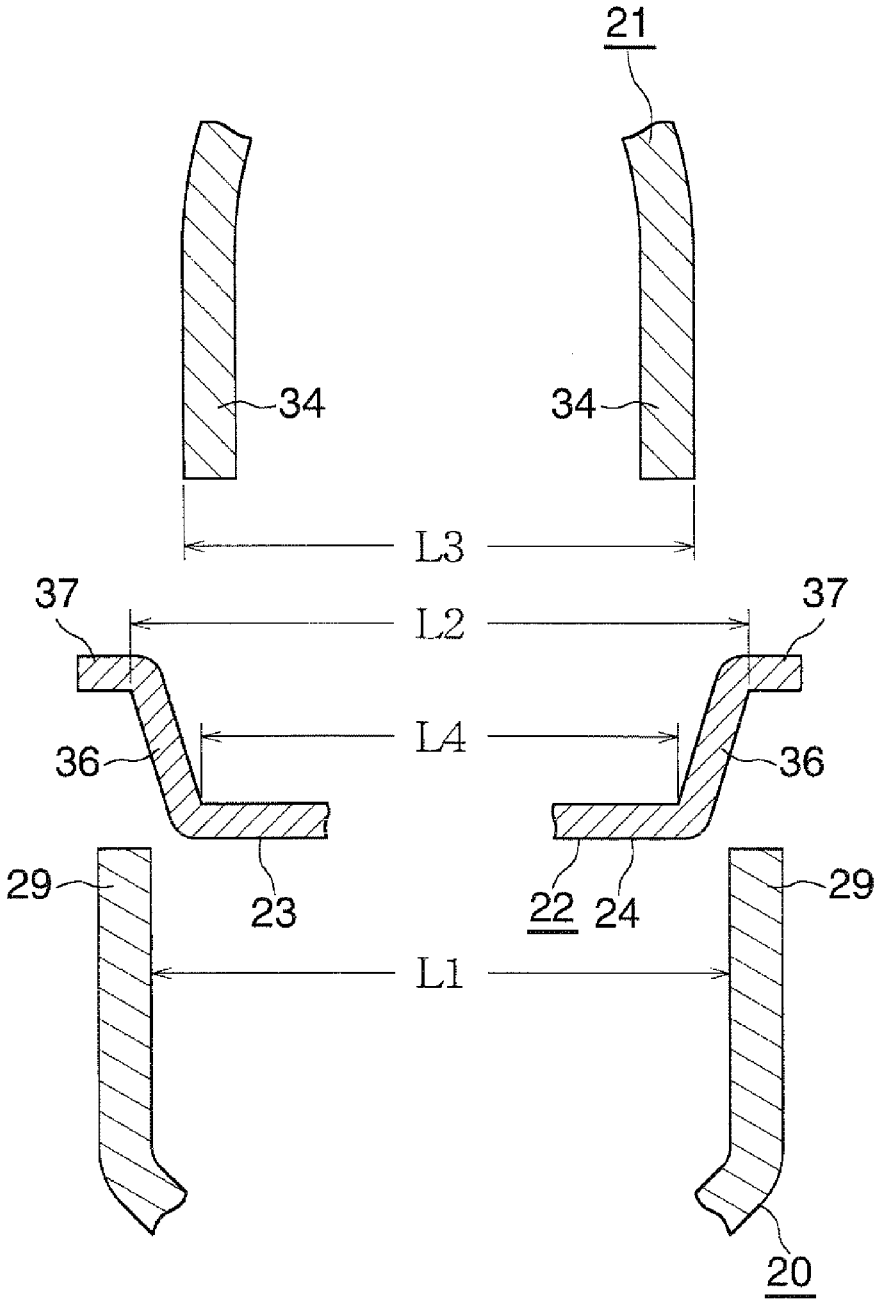
FIG. 4 is a partially omitted enlarged view of a main portion showing one step of a method of manufacturing the evaporator of FIG. 1.

Next, a method of manufacturing the above-described evaporator 1 will be described with reference to FIG. 4.

The first through third tank constituting members 20, 21, and 22, the end member 25, the heat exchange tubes 14, the corrugate fins 17, and the side plates 18 are prepared. Further, components, other than the first through third tank constituting members 20, 21, and 22, which form the upper header tank 2 and the lower header tank 3 are prepared.

At that time, the two intermediate vertical wall portions 36 of the third tank constituting member 20 are inclined outward (with respect to the air-passing direction) toward the outer ends thereof with respect to the vertical direction such that the distance L1 between the inner surfaces of the two outer vertical wall portions 29 measured at the outer ends (with respect to the vertical direction) (distal ends) thereof is smaller than the distance L2 between the outer surfaces of the two intermediate vertical wall portions 36 measured at the outer ends (with respect to the vertical direction) (distal ends) thereof, and the distance L3 between the outer surfaces of the two inner vertical wall portions 34 measured at the inner ends (with respect to the vertical direction) (distal ends) thereof is greater than the distance L4 between the inner surfaces of the two intermediate vertical wall portion 36 measured at the inner ends (with respect to the vertical direction) (base ends) thereof. Notably, the distance L1 between the inner surfaces of the two outer vertical wall portions 29 measured at the outer ends (with respect to the vertical direction) thereof is greater that the distance between the outer surfaces of the two intermediate vertical wall portions 36 measured at the inner ends (with respect to the vertical direction), and the distance L3 between the outer surfaces of the two inner vertical wall portions 34 measured at the inner ends (with respect to the vertical direction) thereof is smaller than the distance between the inner surfaces of the two intermediate vertical wall portions 36 measured at the outer ends (with respect to the vertical direction) thereof.

The first through third tank constituting members 20, 21, and 22 are assembled together such that the two outer vertical wall portions 29, the two inner vertical wall portions 34, and the two intermediate vertical wall portions 36 are laminated. Subsequently, the first through third tank constituting members 20, 21, and 22 are fixed together through crimping (press-fitting) performed at the connection walls 28, 33, and 35. At that time, the two outer vertical wall portions 29 elastically deform such that they slightly open outward in the air-passing direction, the two inner vertical wall portions 34 elastically deform such that they slightly close inward in the air-passing direction, and the two intermediate vertical wall portions 36 elastically deform such that their extending directions slightly approach the vertical direction. As a result, the distal end surfaces of the inner vertical wall portions 34 butt against parts of the partition portions 23 and 24 of the third tank constituting member 22, the parts being adjacent to the base ends of the intermediate vertical wall portions 36, and the distal end surfaces of the outer vertical wall portions 29 butt against the outward projecting portions 37 provided at the distal ends of the intermediate vertical wall portions 36. In addition, due to elastic forces produced as a result of the elastic deformations of the two outer vertical wall portions 29, the two inner vertical wall portions 34, and the two intermediate vertical wall portions 36, the distal end surfaces of the inner vertical wall portions 34 are pressed against the parts of the partition portions 23 and 24 adjacent to the base ends of the intermediate vertical wall portions 36, and the distal end surfaces of the outer vertical wall portions 29 are pressed against the outward projecting portions 37 provided at the distal ends of the intermediate vertical wall portions 36.

Also, when the first through third tank constituting members 20, 21, and 22 are assembled, the components, other than the first through third tank constituting members 20, 21, and 22, which form the upper header tank 2 and the lower header tank 3 are assembled. Moreover, the end member 25, the heat exchange tubes 14, the corrugate fins 17, and the side plates 18 are assembled, and all the components are provisionally fixed together.

After that, the upper and lower header tanks 2 and 3 are made by brazing together the first through third tank constituting members 20, 21, and 22 and the other tank constituting components, and simultaneously, the end member 25, the heat exchange tubes 14, the corrugate fins 17, and the side plates 18 are brazed together. In this manner, the evaporator 1 is manufactured.

Figure 5:
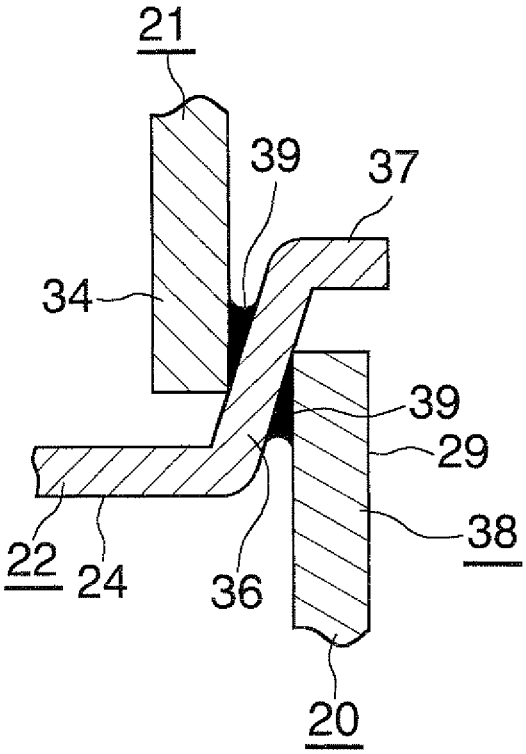
FIG. 5 is a view corresponding to FIG. 2 and showing a modification of the header tank of the evaporator to which the heat exchanger according to the embodiment is applied.

FIG. 5 shows the structure of a main portion of a modification of the header tank of the evaporator.

In the case of the header tank shown in FIG. 5, at each of the laminated portions 38 formed as a result of overlapping of the vertical wall portions 29, 34, and 36 of the first through third tank constituting members 20, 21, and 22, the inner edge (with respect to the air-passing direction) of the distal end surface of each outer vertical wall portion 29 of the first tank constituting member 20 is in engagement with the outer surface (with respect to the air-passing direction) of the corresponding intermediate vertical wall portion 36 of the third tank constituting member 22, and the outer edge (with respect to the air-passing direction) of the distal end surface of each inner vertical wall portion 34 of the second tank constituting member 21 is in engagement with the inner surface (with respect to the air-passing direction) of the corresponding intermediate vertical wall portion 36 of the third tank constituting member 22.

As viewed on a transverse cross section, the outer surface (with respect to the air-passing direction) of the intermediate vertical wall portion 36 and the inner surface (with respect to the air-passing direction) of the outer vertical wall portion 29 of the first tank constituting member 20 meet and form an acute angle therebetween, and the inner surface (with respect to the air-passing direction) of the intermediate vertical wall portion 36 and the outer surface (with respect to the air-passing direction) of the inner vertical wall portion 34 of the second tank constituting member 21 meet and form an acute angle therebetween. A fillet 39 is formed between the outer surface (with respect to the air-passing direction) of the intermediate vertical wall portion 36 and the inner surface (with respect to the air-passing direction) of the outer vertical wall portion 29, and another fillet 39 is formed between the inner surface (with respect to the air-passing direction) of the intermediate vertical wall portion 36 and the outer surface (with respect to the air-passing direction) of the inner vertical wall portion 34.

In the above-described embodiment, the vertical wall portions 29 of the first tank constituting member 20 are located on the outer sides of the intermediate vertical wall portions 36 of the third tank constituting member 22, and the vertical wall portions 34 of the second tank constituting member 21 are located on the inner sides of the intermediate vertical wall portions 36 of the third tank constituting member 22. However, however, the embodiment may be modified such that the vertical wall portions 29 of the first tank constituting member 20 are located on the inner sides of the intermediate vertical wall portions 36 of the third tank constituting member 22, and the vertical wall portions 34 of the second tank constituting member 21 are located on the outer sides of the intermediate vertical wall portions 36 of the third tank constituting member 22. In this case, the intermediate vertical wall portions 36 of the third tank constituting member 22 are formed to project from the partition portions 23 and 24 toward the inner side with respect to the vertical direction (i.e., project downward in the upper header tank 2, and project upward in the lower header tank 3), and are inclined outward in the air-passing direction toward the distal ends thereof. As a result, as viewed on a transverse cross section, the outer surface (with respect to the air-passing direction) of the intermediate vertical wall portion 36 and the inner surface (with respect to the air-passing direction) of the outer vertical wall portion 29 of the first tank constituting member 20 meet and form an acute angle therebetween, and the inner surface (with respect to the air-passing direction) of the intermediate vertical wall portion 36 and the outer surface (with respect to the air-passing direction) of the inner vertical wall portion 34 of the second tank constituting member 21 meet and form an acute angle therebetween.

1) A heat exchanger including a pair of header tanks disposed apart from each other such that their width direction coincides with an air-passing direction, and a plurality of heat exchange tubes which are disposed between the two header tanks and whose opposite end portions are connected to the corresponding header tanks, at least one of the header tanks including a first tank constituting member to which the heat exchange tubes are connected, a second tank constituting member which is joined to the first tank constituting member and which covers one side of the first tank constituting member opposite the heat exchange tubes, and a third tank constituting member which is disposed between the first and second tank constituting members, the header tank which includes the three tank constituting members having laminated portions which are formed at opposite edges of the header tank with respect to the air-passing direction as a result of overlapping of vertical wall portions of the tank constituting members formed at opposite edges thereof with respect to the air-passing direction, each of the laminated portions being composed of an outer vertical wall portion located at the outermost position, an inner vertical wall located at the innermost position, and an intermediate vertical wall portion located between the outer and inner vertical wall portions, the outer vertical wall portion being provided on one of the first and second tank constituting members, the inner vertical wall portion being provided on the other of the first and second tank constituting members, and the intermediate vertical wall portion being provided on the third tank constituting member, wherein the intermediate vertical wall portion of the third tank constituting member is inclined outward in the air-passing direction toward a distal end thereof such that as viewed on a transverse cross section, an outer surface of the intermediate vertical wall portion with respect to the air-passing direction and an inner surface of the outer vertical wall portion with respect to the air-passing direction meet and form an acute angle therebetween and an inner surface of the intermediate vertical wall portion with respect to the air-passing direction and an outer surface of the inner vertical wall portion with respect to the air-passing direction meet and form an acute angle therebetween; and a fillet is formed between the outer surface of the intermediate vertical wall portion with respect to the air-passing direction and the inner surface of the outer vertical wall portion with respect to the air-passing direction and another fillet is formed between the inner surface of the intermediate vertical wall portion with respect to the air-passing direction and the outer surface of the inner vertical wall portion with respect to the air-passing direction.

2) A heat exchanger according to par. 1), wherein a distal end surface of the inner vertical wall portion butts against a portion of the third tank constituting member which portion is located adjacent to a base end of the intermediate vertical wall portion, and a distal end surface of the outer vertical wall portion butts against an outward projecting portion which projects outward with respect to the air-passing direction from the distal end of the intermediate vertical wall portion.

3) A heat exchanger according to par. 1), wherein an inner edge of a distal end surface of the outer vertical wall portion which edge is located on the inner side with respect to the air-passing direction is in engagement with the outer surface of the intermediate vertical wall portion with respect to the air-passing direction, and an outer edge of a distal end surface of the inner vertical wall portion which edge is located on the outer side with respect to the air-passing direction is in engagement with the inner surface of the intermediate vertical wall portion with respect to the air-passing direction.

4) A heat exchanger according to par. 1), wherein the outer vertical wall portion is provided on the first tank constituting member, and the inner vertical wall portion is provided on the second tank constituting member.

5) A method of manufacturing the heat exchanger according to par. 1), including the steps of forming the first through third tank constituting members such that the two intermediate vertical wall portions of the third tank constituting member are inclined outward with respect to the air-passing direction toward the distal ends thereof, a distance between the inner surfaces of the two outer vertical wall portions measured at the distal ends thereof is smaller than a distance between the outer surfaces of the two intermediate vertical wall portions measured at the distal ends thereof, and a distance between the outer surfaces of the two inner vertical wall portions measured at the distal ends thereof is larger than a distance between the inner surfaces of the two intermediate vertical wall portions measured at the base ends thereof; and assembling the first through third tank constituting members together such that the outer vertical wall portions, the inner vertical wall portions, and the intermediate vertical wall portions are laminated.

6) A manufacturing method according to par. 5), wherein a distal end surface of each inner vertical wall portion is caused to butt against a portion of the third tank constituting member which portion is located adjacent to a base end of the intermediate vertical wall portion, and a distal end surface of each outer vertical wall portion is caused to butt against an outward projecting portion which projects outward with respect to the air-passing direction from the distal end of the corresponding intermediate vertical wall portion.

7) A manufacturing method according to par. 5), wherein an inner edge of a distal end surface of each outer vertical wall portion which edge is located on the inner side with respect to the air-passing direction is brought into engagement with the outer surface of the corresponding intermediate vertical wall portion with respect to the air-passing direction, and an outer edge of a distal end surface of each inner vertical wall portion which edge is located on the outer side with respect to the air-passing direction is brought into engagement with the inner surface of the corresponding intermediate vertical wall portion with respect to the air-passing direction.

8) A manufacturing method according to par. 5), wherein the outer vertical wall portions are provided on the first tank constituting member, and the inner vertical wall portions are provided on the second tank constituting member.

According to the heat exchanger of any of pars. 1) to 4), the third tank constituting member is inclined outward in the air-passing direction toward a distal end thereof such that as viewed on a transverse cross section, an outer surface of the intermediate vertical wall portion with respect to the air-passing direction and an inner surface of the outer vertical wall portion with respect to the air-passing direction meet and form an acute angle therebetween and an inner surface of the intermediate vertical wall portion with respect to the air-passing direction and an outer surface of the inner vertical wall portion with respect to the air-passing direction meet and form an acute angle therebetween; and a fillet is formed between the outer surface of the intermediate vertical wall portion with respect to the air-passing direction and the inner surface of the outer vertical wall portion with respect to the air-passing direction and another fillet is formed between the inner surface of the intermediate vertical wall portion with respect to the air-passing direction and the outer surface of the inner vertical wall portion with respect to the air-passing direction. As a result, the outer vertical wall portion, the inner vertical wall portion, and the intermediate vertical wall portion are brazed together completely, whereby leakage from the header tanks can be prevented.

According to the manufacturing method of any of pars. 5) to 8), when the first through third tank constituting members are assembled together such that the outer vertical wall portions, the inner vertical wall portions, and the intermediate vertical wall portions are laminated, as viewed on a transverse cross section, the outer surface of the intermediate vertical wall portion with respect to the air-passing direction and the inner surface of the outer vertical wall portion with respect to the air-passing direction meet and form an acute angle therebetween and the inner surface of the intermediate vertical wall portion with respect to the air-passing direction and the outer surface of the inner vertical wall portion with respect to the air-passing direction meet and form an acute angle therebetween. Accordingly, at the time of brazing in a subsequent step, it is possible to form a fillet between the outer surface of the intermediate vertical wall portion with respect to the air-passing direction and the inner surface of the outer vertical wall portion with respect to the air-passing direction and to form another filet between the inner surface of the intermediate vertical wall portion with respect to the air-passing direction and the outer surface of the inner vertical wall portion with respect to the air-passing direction. As a result, the outer vertical wall portion, the inner vertical wall portion, and the intermediate vertical wall portion can be brazed together completely.

Obviously, numerous modifications and variations of the present invention are possible in light of the above teachings. It is therefore to be understood that within the scope of the appended claims, the invention may be practiced otherwise than as specifically described herein.

What is claimed is:

1. A heat exchanger comprising:

a first header tank provided to extend in a first direction;

a second header tank provided to extend in the first direction;

heat exchange tubes provided between the first header tank and the second header tank to extend in a second direction substantially perpendicular to the first direction, the heat exchange tubes having first ends and second ends opposite to the first ends in the second direction, the first ends being connected to the first header tank, the second ends being connected to the second header tank;

at least one of the first header tank and the second header tank comprising:

a first tank constituting member to which the heat exchange tubes are connected and which has a first peripheral end wall portion having a first edge extending in the first direction;

a second tank constituting member having a second peripheral end wall portion which is overlapped with the first peripheral end wall portion at an overlapped portion and which has a second edge extending in the first direction; and a third tank constituting member which is disposed between the first tank constituting member and the second tank constituting member and which has a third peripheral end wall portion having a first side surface facing the first peripheral end wall portion and a second side surface which is opposite to the first side surface and which faces the second peripheral end wall portion, the first side surface and the second side surface of the third peripheral end wall portion being obliquely provided between the first peripheral end wall portion and the second peripheral end wall portion at the overlapped portion so that the first edge of the first peripheral end wall portion is in line contact with the first side surface of the third peripheral end wall portion at a first line contact portion and so that the second edge of the second peripheral end wall portion is in line contact with the second side surface of the third peripheral end wall portion at a second line contact portion;

a first fillet provided at the first line contact portion between the third peripheral end wall portion and the first peripheral end wall portion to connect the first tank constituting member and the third tank constituting member; and a second fillet provided at the second line contact portion between the third peripheral end wall portion and the second peripheral end wall portion to connect the second tank constituting member and the third tank constituting member, wherein the first fillet is provided on the first side surface of the third peripheral end wall portion and the second fillet is provided on the second side surface of the third peripheral end wall portion.

2. The heat exchanger according to claim 1, wherein the third tank constituting member comprises a flat wall disposed between the first tank constituting member and the second tank constituting member and extending in a third direction perpendicular to the first and second directions, an outer peripheral edge of the flat wall being connected to an inner periphery of the third peripheral end wall portion, a distal end of the second peripheral end wall portion contacting the outer peripheral edge of the flat wall, and an outward projecting portion which extends in the third direction and whose inner peripheral edge is connected to an outer periphery of the third peripheral end wall portion, a distal end of the first peripheral end wall portion contacting the inner peripheral edge of the outward projecting portion.

3. The heat exchanger according to claim 1, wherein the third tank constituting member is a separate member from the first tank constituting member and the second tank constituting member.

4. The heat exchanger according to claim 1, wherein the third peripheral end wall portion has a substantially constant thickness as the third peripheral end wall portion extends from the first peripheral end wall portion to the second peripheral end wall portion.

5. The heat exchanger according to claim 1, wherein, at the first line contact portion, the first side surface of the third peripheral end wall portion and an adjacent side of the first peripheral end wall portion form a first acute angle therebetween, and wherein, at the second line contact portion, the second side surface of the third peripheral end wall portion and an adjacent side of the second peripheral end wall portion form a second acute angle therebetween.

* * * * *